US011732611B1

(12) United States Patent
Hu et al.

(10) Patent No.: US 11,732,611 B1
(45) Date of Patent: Aug. 22, 2023

(54) LONG-ARM FLANGE DESIGN FOR CONNECTING AND SUPPORTING THIN-WALLED PARTS SUBJECT TO HIGH BENDING AND THERMAL LOADS

(71) Applicant: Solar Turbines Incorporated, San Diego, CA (US)

(72) Inventors: Gusheng Hu, San Diego, CA (US); John F. Lockyer, San Diego, CA (US); Oscar Sanchez Kuri, Tijuana (MX); George L. Prater, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 17/589,676

(22) Filed: Jan. 31, 2022

(51) Int. Cl.
*F01D 25/24* (2006.01)
*F01D 25/28* (2006.01)

(52) U.S. Cl.
CPC ..... *F01D 25/243* (2013.01); *F01D 25/28* (2013.01); *F05D 2230/232* (2013.01); *F05D 2240/14* (2013.01); *F05D 2250/292* (2013.01); *F05D 2260/31* (2013.01)

(58) Field of Classification Search
CPC ..... F01D 25/24; F01D 25/243; F01D 25/246; F01D 25/28; F01D 25/30; F01D 11/08; F04D 29/44; F04D 29/441; F04D 29/442; F04D 29/447; F04D 29/445; F05D 2240/14; F05D 2250/292
See application file for complete search history.

(56) References Cited

U.S. PATENT DOCUMENTS

| | | | | |
|---|---|---|---|---|
| 4,730,832 | A * | 3/1988 | Cederwall | B23P 19/04 277/630 |
| 5,230,540 | A * | 7/1993 | Lewis | F16L 23/162 285/368 |
| 6,176,663 | B1 | 1/2001 | Nguyen et al. | |
| 8,079,773 | B2 | 12/2011 | Blanton | |
| 2014/0047813 | A1* | 2/2014 | Frailich | F01D 25/30 60/39.5 |
| 2021/0285332 | A1* | 9/2021 | Frey | F01D 25/246 |

* cited by examiner

*Primary Examiner* — David E Sosnowski
*Assistant Examiner* — Maxime M Adjagbe
(74) *Attorney, Agent, or Firm* — Procopio, Cory, Hargreaves & Savitch LLP

(57) ABSTRACT

Exhaust outlets (e.g., in a gas turbine engine) are generally made from sections of thin-walled materials (e.g., sheet metal) that are joined by flanges. Due to the length of the exhaust outlet and differing thermal expansion coefficients exhibited by the flanges and the thin-walled materials, these joints are subjected to high mechanical, as well as thermal, stresses. A long-arm flange is disclosed that decouples the mechanical stress from the thermal stress in the flange and distributes the stress, to thereby reduce the stress at the flange interface. Additionally, the long-arm flange can be easily adapted to the specific geometry of any exhaust outlet.

20 Claims, 5 Drawing Sheets

LONG-ARM FLANGE DESIGN FOR CONNECTING AND SUPPORTING THIN-WALLED PARTS SUBJECT TO HIGH BENDING AND THERMAL LOADS

TECHNICAL FIELD

The embodiments described herein are generally directed to an exhaust outlet, and, more particularly, to long-arm flanges for connecting and supporting thin-walled parts of an exhaust outlet that are subject to high bending and thermal loads.

BACKGROUND

An exhaust outlet of a turbomachine, such as a gas turbine engine, is often constructed from thin-walled parts. For example, a typical exhaust outlet comprises cones made of sheet metal with a thickness ranging from 0.09 inches to 0.16 inches. These thin-walled parts may be exposed to an environment of elevated back-pressure and high exhaust temperatures (e.g., nearing or exceeding 1,000° F.).

Consequently, the supporting "backbone" structure, including the flanges supporting and connecting the thin-walled parts, are subject to high bending-moment load, as well as high thermal loads resulting from the use of different materials or large temperature gradients across the flanges. The high levels of stress experienced by conventional flanges will reduce the flanges' lifetime and compromise the flanges' durability. This is particularly true and even more challenging for a large system in which the thin-walled parts, needing to be connected and supported, span a large distance.

Conventional solutions fail to address these particular problems. For example, U.S. Pat. No. 5,230,540, issued on Jul. 27, 1993, is focused on a flange configuration that provides sealing against internal pressures. However, this reference does not address the high bending-moment loads and thermal loads described above.

The present disclosure is directed toward overcoming one or more of the problems discovered by the inventors.

SUMMARY

In an embodiment, a flange comprises: a flange portion extending in a radial direction; a tapered portion extending from the flange portion in an axial direction that is perpendicular to the radial direction, the tapered portion having a first end that is closest to the flange portion and a second end that is farthest from the flange portion, the tapered portion being thicker at the first end than at the second end; and a tip portion on an opposite side of the tapered portion as the flange portion, the tip portion having a different thickness than the second end of the tapered portion.

In an embodiment, an exhaust outlet comprises: a hub having a longitudinal axis; a shroud cone encircling the hub to define an annular flow path between the hub and the shroud cone; and a long-arm flange comprising a flange portion extending in a radial direction that is orthogonal to the longitudinal axis, a tapered portion extending from the flange portion in an axial direction that is parallel to the longitudinal axis, the tapered portion having a first end that is closest to the flange portion and a second end that is farthest from the flange portion, the tapered portion being thicker at the first end than at the second end, and a tip portion on an opposite side of the tapered portion as the flange portion, the tip portion having a different thickness than the second end of the tapered portion; wherein each of the hub and the shroud comprises one or more sections; and wherein the tip portion of the long-arm flange is welded to an end of one of the one or more sections.

In an embodiment, an exhaust outlet comprises: a hub having a longitudinal axis, the hub including a forward hub section, a middle hub section, and an aft hub section; a shroud cone encircling the hub to define an annular flow path between the hub and the shroud cone; and a plurality of long-arm flanges, each of the plurality of long-arm flanges including a flange portion extending in a radial direction that is orthogonal to the longitudinal axis, a tapered portion extending from the flange portion in an axial direction that is parallel to the longitudinal axis, the tapered portion having a first end that is closest to the flange portion and a second end that is farthest from the flange portion, the tapered portion being thicker at the first end than at the second end, and a tip portion on an opposite side of the tapered portion as the flange portion, the tip portion having a different thickness than the second end of the tapered portion; wherein the plurality of long-arm flanges comprises a first long-arm flange whose tip portion is welded to an upstream end of the shroud cone, a second long-arm flange whose tip portion is welded to an upstream end of the forward hub section, a third long-arm flange whose tip portion is welded to a downstream end of the forward hub section, a fourth long-arm flange whose tip portion is welded to an upstream end of the middle hub section and whose flange portion is fastened to the flange portion of the third long-arm flange, a fifth long-arm flange whose tip portion is welded to a downstream end of the middle hub section, and a sixth long-arm flange whose tip portion is welded to an upstream end of the aft hub section and whose flange portion is fastened to the flange portion of the fifth long-arm flange.

BRIEF DESCRIPTION OF THE DRAWINGS

The details of embodiments of the present disclosure, both as to their structure and operation, may be gleaned in part by study of the accompanying drawings, in which like reference numerals refer to like parts, and in which.

DETAILED DESCRIPTION

Figure 1:
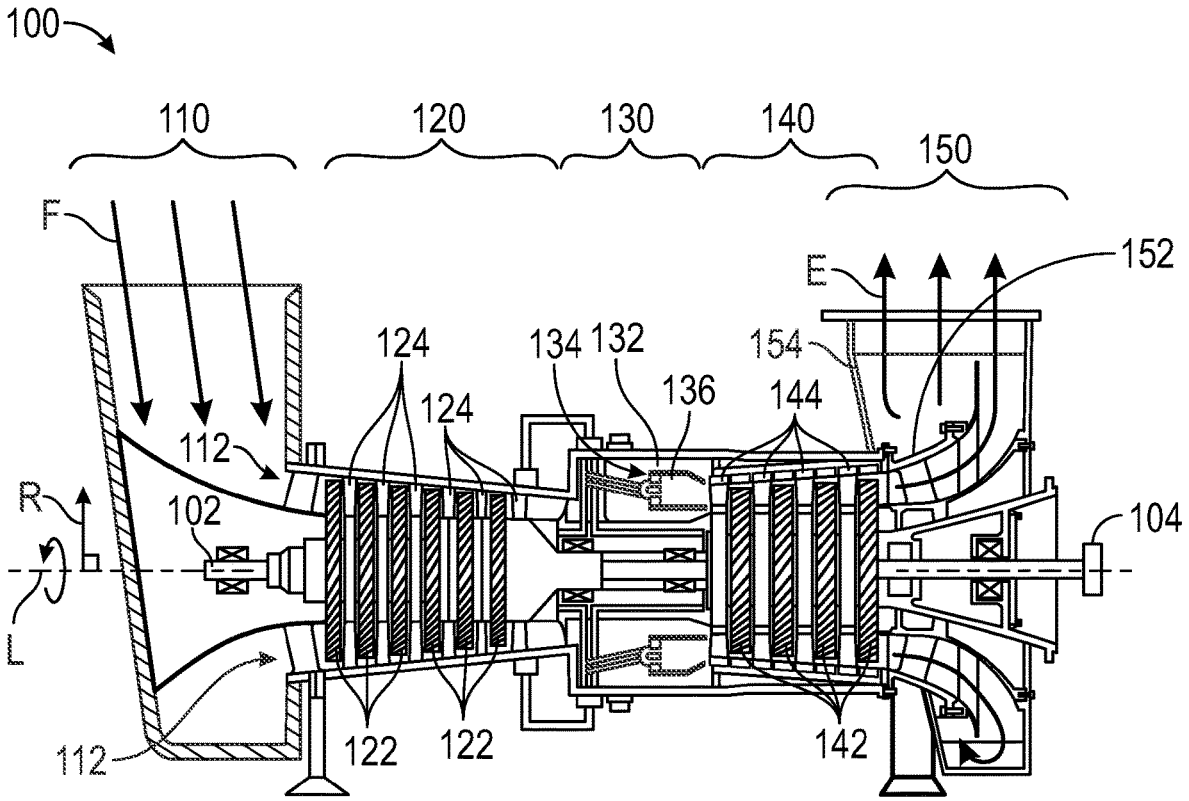
FIG. 1 illustrates a schematic diagram of a gas turbine engine, according to an embodiment.

The detailed description set forth below, in connection with the accompanying drawings, is intended as a description of various embodiments, and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description.

For clarity and ease of explanation, some surfaces and details may be omitted in the present description and figures. In addition, references herein to "upstream" and "downstream" or "forward" and "aft" are relative to the flow direction of the primary gas (e.g., air) used in the combustion process, unless specified otherwise. It should be understood that "upstream," "forward," and "leading" refer to a position that is closer to the source of the primary gas or a direction towards the source of the primary gas, and "downstream," "aft," and "trailing" refer to a position that is farther from the source of the primary gas or a direction that is away from the source of the primary gas. Thus, a trailing edge or end of a component (e.g., a turbine blade) is downstream from a leading edge or end of the same component. Also, it should be understood that, as used herein, the terms "side," "top," "bottom," "front," "rear," "above," "below," and the like are used for convenience of understanding to convey the relative positions of various components with respect to each other, and do not imply any specific orientation of those components in absolute terms (e.g., with respect to the external environment or the ground).

It should also be understood that the various components illustrated herein are not necessarily drawn to scale. In other words, the features disclosed in various embodiments may be implemented using different relative dimensions within and between components than those illustrated in the drawings.

FIG. 1 illustrates a schematic diagram of a gas turbine engine 100, according to an embodiment. Gas turbine engine 100 comprises a shaft 102 with a central longitudinal axis L. A number of other components of gas turbine engine 100 are concentric with longitudinal axis L and may be annular to longitudinal axis L. A radial axis may refer to any axis or direction that radiates outward from longitudinal axis L at a substantially orthogonal angle to longitudinal axis L, such as radial axis R in FIG. 1. Thus, the term "radially outward" should be understood to mean farther from or away from longitudinal axis L, whereas the term "radially inward" should be understood to mean closer or towards longitudinal axis L. As used herein, the term "radial" will refer to any axis or direction that is substantially perpendicular to longitudinal axis L, and the term "axial" will refer to any axis or direction that is substantially parallel to longitudinal axis L.

In an embodiment, gas turbine engine 100 comprises, from an upstream end to a downstream end, an inlet 110, a compressor 120, a combustor 130, a turbine 140, and an exhaust outlet 150. In addition, the downstream end of gas turbine engine 100 may comprise a power output coupling 104. One or more, including potentially all, of these components of gas turbine engine 100 may be made from stainless steel and/or durable, high-temperature materials known as "superalloys." A superalloy is an alloy that exhibits excellent mechanical strength and creep resistance at high temperatures, good surface stability, and corrosion and oxidation resistance. Examples of superalloys include, without limitation, Hastelloy, Inconel, Waspaloy, Rene alloys, Haynes alloys, Incoloy, MP98T, TMS alloys, and CMSX single crystal alloys.

Inlet 110 may funnel a working fluid F (e.g., the primary gas, such as air) into an annular flow path 112 around longitudinal axis L. Working fluid F flows through inlet 110 into compressor 120. While working fluid F is illustrated as flowing into inlet 110 from a particular direction and at an angle that is substantially orthogonal to longitudinal axis L, it should be understood that inlet 110 may be configured to receive working fluid F from any direction and at any angle that is appropriate for the particular application of gas turbine engine 100. While working fluid F will primarily be described herein as air, it should be understood that working fluid F could comprise other fluids, including other gases.

Compressor 120 may comprise a series of compressor rotor assemblies 122 and stator assemblies 124. Each compressor rotor assembly 122 may comprise a rotor disk that is circumferentially populated with a plurality of rotor blades. The rotor blades in a rotor disk are separated, along the axial axis, from the rotor blades in an adjacent disk by a stator assembly 124. Compressor 120 compresses working fluid F through a series of stages corresponding to each compressor rotor assembly 122. The compressed working fluid F then flows from compressor 120 into combustor 130.

Combustor 130 may comprise a combustor case 132 that houses one or more, and generally a plurality of, fuel injectors 134. In an embodiment with a plurality of fuel injectors 134, fuel injectors 134 may be arranged circumferentially around longitudinal axis L within combustor case 132 at equidistant intervals. Combustor case 132 diffuses working fluid F, and fuel injector(s) 134 inject fuel into working fluid F. This injected fuel is ignited to produce a combustion reaction in one or more combustion chambers 136. The combusting fuel-gas mixture drives turbine 140.

Turbine 140 may comprise one or more turbine rotor assemblies 142 and stator assemblies 144 (e.g., nozzles). Each turbine rotor assembly 142 may correspond to one of a plurality or series of stages. Turbine 140 extracts energy from the combusting fuel-gas mixture as it passes through each stage. The energy extracted by turbine 140 may be transferred (e.g., to an external system) via power output coupling 104.

The exhaust E from turbine 140 may flow into exhaust outlet 150. Exhaust outlet 150 may comprise an exhaust diffuser 152, which diffuses exhaust E, and an exhaust collector 154 which collects, redirects, and outputs exhaust E. It should be understood that exhaust E, output by exhaust collector 154, may be further processed, for example, to reduce harmful emissions, recover heat, and/or the like. In addition, while exhaust E is illustrated as flowing out of exhaust outlet 150 in a specific direction and at an angle that is substantially orthogonal to longitudinal axis L, it should be understood that exhaust outlet 150 may be configured to output exhaust E towards any direction and at any angle that is appropriate for the particular application of gas turbine engine 100.

Figure 2:
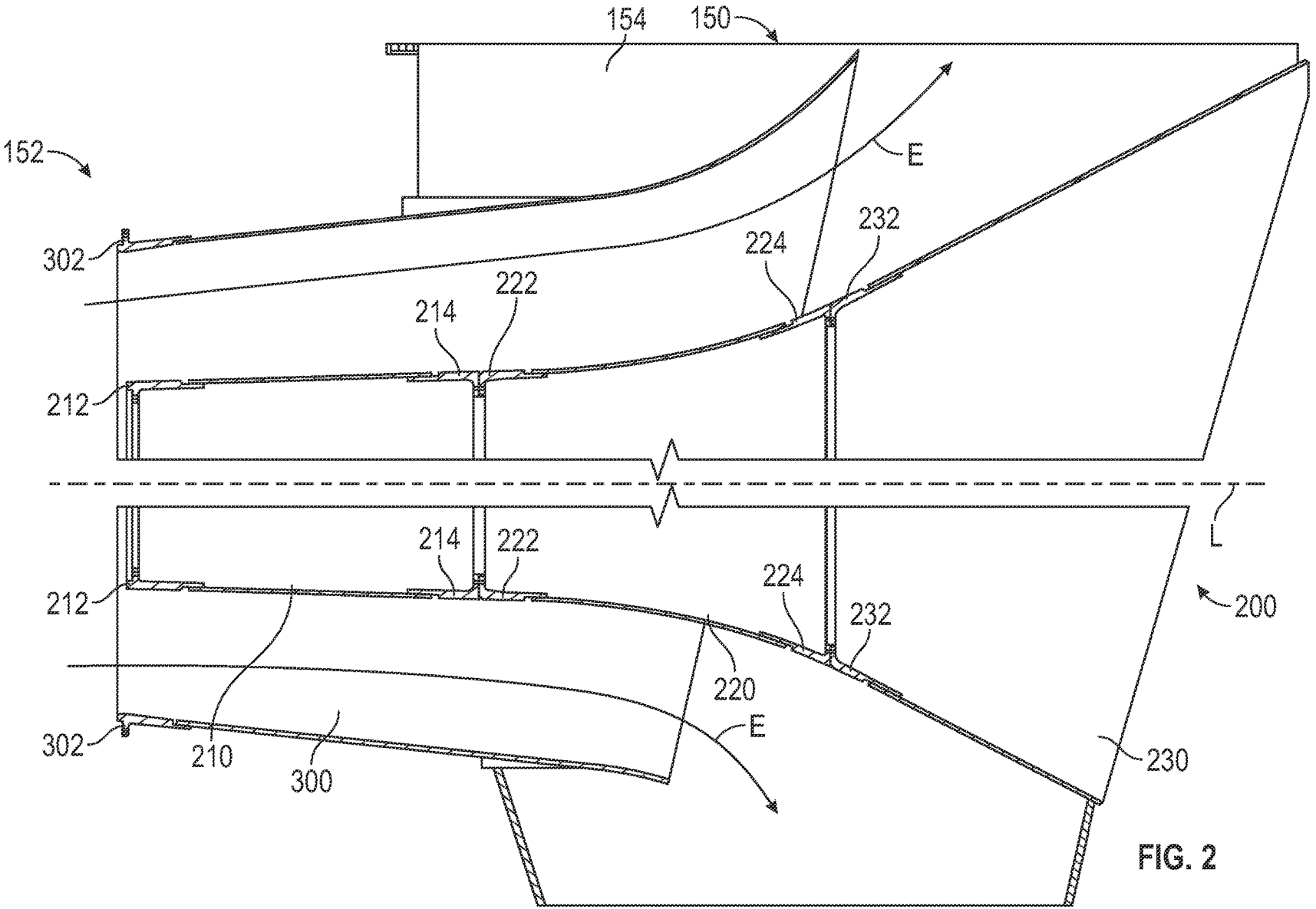
FIG. 2 illustrates a schematic diagram of an exhaust outlet, according to an embodiment.

FIG. 2 illustrates a schematic diagram of exhaust outlet 150, according to an embodiment. Exhaust diffuser 152 comprises a hub 200 and a shroud cone 300. It should be understood that both hub 200 and shroud cone 300 are annular around longitudinal axis L. In addition, hub 200 and shroud cone 300 may be concentric around longitudinal axis L, with shroud cone 300 encircling hub 200, so as to form an annular flow path, between the exterior surface of hub 200 and the interior surface of shroud cone 300, for the flow of exhaust E. In an embodiment, the downstream end of exhaust diffuser 152 opens into an interior of exhaust collector 154, such that the annular flow path ends in the interior of exhaust collector 154. Thus, exhaust E collects within exhaust collector 154 and may be exhausted through an open end of exhaust collector 154.

Along longitudinal axis L, from upstream to downstream, hub 200 may comprise a forward hub section 210, a middle hub section 220, and an aft hub section 230. In an alternative embodiment, hub 200 may consist of any different number of hub sections, including a single hub section, two hub sections, or four or more hub sections. It should be understood that each hub section is annular around longitudinal axis L. Hub sections may by substantially cylindrical or substantially frustum-shaped, comprise the shape of a flared frustum that curves radially outward from the upstream end to the downstream end according to a radius of curvature, and/or comprise any other shape. In the illustrated embodiment, forward hub section 210 is substantially cylindrical or frustum-shaped, middle hub section 220 comprises the shape of a flared frustum, and aft hub section 230 comprises the shape of a flared frustum with an angled backwall that is angled with respect to a radial axis that is orthogonal to longitudinal axis L. However, it should be understood that other shapes and configurations and other combinations of shapes and configurations are possible.

As with hub 200, shroud cone 300 may comprise one or a plurality of sections. Shroud cone 300 may substantially follow the shape of the forward portion of hub 200 (e.g., forward hub section 210 and middle hub section 220), but with a greater diameter, so as to define the annular flow path for exhaust E. Thus, as illustrated, from upstream to downstream, shroud cone 300 comprises a substantially frustum-shaped forward portion around forward hub section 210 and a forward portion of middle hub section 220, that transitions into the shape of a flared frustum around the aft portion of middle hub section 220. Similarly to hub 200, the downstream end of shroud cone 300 may be angled with respect to a radial axis (e.g., at the same angle as the angled backwall of aft hub section 230). However, it should be understood that other shapes and configurations are possible.

In an embodiment, hub 200 comprises a long-arm flange 212 at the upstream end of hub 200. Long-arm flange 212 may be used to join hub 200 to a corresponding flange of an upstream component, such as a corresponding flange on the downstream end of turbine 140.

Similarly, shroud cone 300 may comprise a long-arm flange 302 at the upstream end of shroud cone 300. Long-arm flange 302 may be used to join shroud cone 300 to a corresponding flange of an upstream component, such as a corresponding flange on the downstream end of turbine 140.

Generally, it is more cost effective and efficient to manufacture hub 200 and/or shroud cone 300 as a plurality of separate sections that are joined by flanges during assembly. The manufacture of hub 200 and/or shroud cone 300 as separate sections may also facilitate the additive manufacturing of their components. For example, in the illustrated embodiment, hub 200 comprises forward hub section 210 that is joined to middle hub section 220 by fastening a long-arm flange 214 on a downstream end of forward hub section 210 to a corresponding long-arm flange 222 on an upstream end of middle hub section 220. Similarly, middle hub section 220 is joined to aft hub section 230 by fastening a long-arm flange 224 on a downstream end of middle hub section 220 to a corresponding long-arm flange 232 on an upstream end of aft hub section 230. It should be understood that hub 200 could comprise more sections that are joined by corresponding long-arm flanges of the same or similar design as those illustrated. In addition, it should be understood that shroud cone 300 could similarly comprise a plurality of sections that are joined by corresponding long-arm flanges of the same or similar design as those illustrated.

Figure 3:
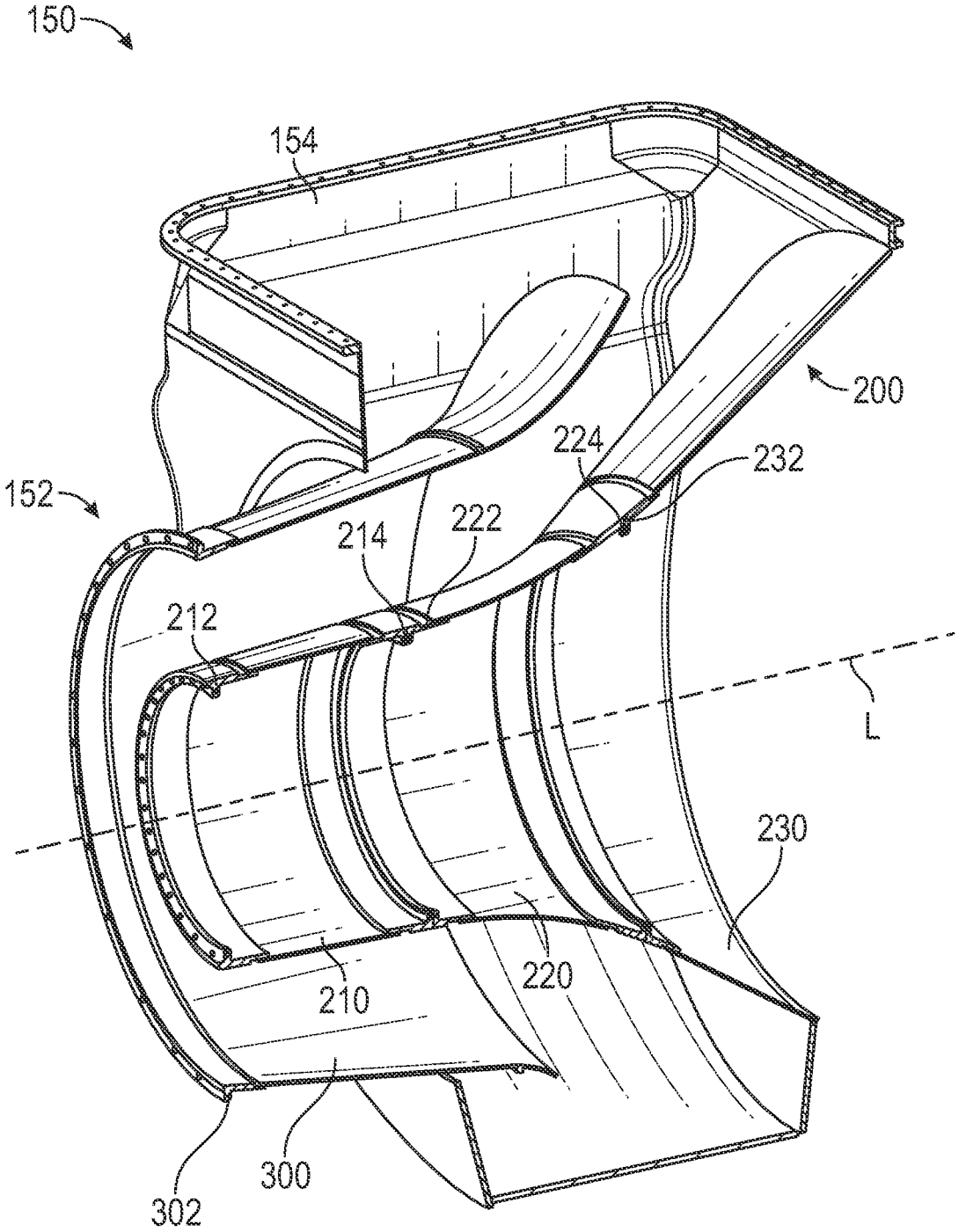
FIG. 3 illustrates a perspective cross-sectional view of an exhaust outlet, according to an embodiment.

FIG. 3 illustrates a perspective cross-sectional view of exhaust outlet 150, according to an embodiment. As illustrated, each of long-arm flanges 212, 214, 222, 224, 232, and 302 are annular around longitudinal axis L. The profiles of hub 200, shroud 300, and each of long-arm flanges 212, 214, 222, 224, 232, and 302 are illustrated as circular, when viewed down longitudinal axis L. However, it should be understood that other profiles are possible, including elliptical and other non-circular profiles. It should also be understood that the exact dimensions of long-arm flanges 212, 214, 222, 224, 232, and 302 and their constituent portions will depend upon the particular design of exhaust outlet 150.

Figure 4:
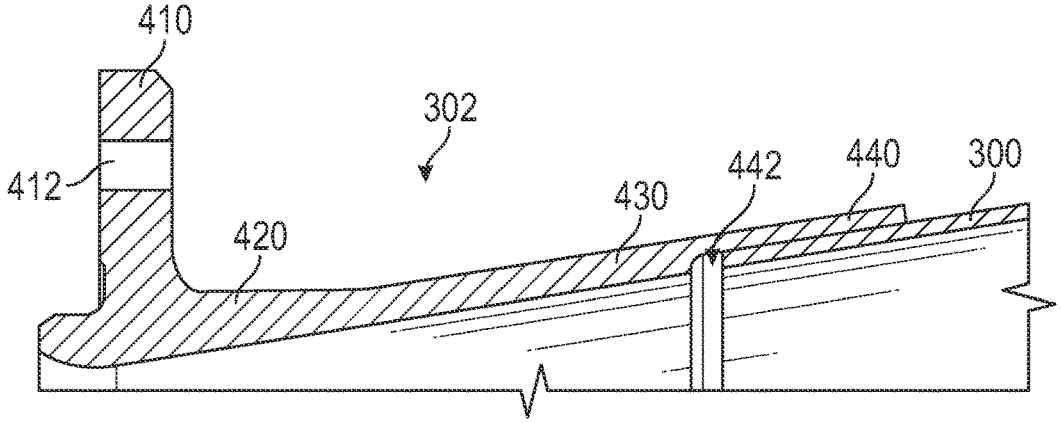
FIGS. 4-8 illustrate cross-sectional views of long-arm flanges, according to various embodiments.

FIG. 4 illustrates a cross-sectional view of long-arm flange 302 in a cross-sectional plane that contains longitudinal axis L, according to an embodiment. Long-arm flange 302 comprises, from an upstream end to a downstream end, a flange portion 410, a tapered portion 420, a middle portion 430, and a tip portion 440.

In an embodiment, flange portion 410 extends along a radial axis (e.g., radially outward from a base of long-arm flange 302), with apertures 412 that extend axially through flange portion 410. It should be understood that a plurality of apertures 412 may be provided at equidistant intervals around the entire annulus formed by flange portion 410. Each aperture 412 may be configured to receive a bolt or pin, may be threaded to receive a screw, or may be configured to receive any other type of fastener. Long-arm flange 302 is configured to be secured to a corresponding flange (e.g., on the downstream end of turbine 140) by bringing flange portion 410 into abutment with the corresponding flange, and inserting and securing a fastener through each aperture 412 and a corresponding aperture on the corresponding flange. However, it should be understood that any means for fastening two flanges together may be used, instead of or in addition to the disclosed means.

In an embodiment, tapered portion 420 extends downstream from flange portion 410 with a wall thickness that gradually decreases in the downstream direction. In other words, the wall of long-arm flange 302 at an upstream end of tapered portion 420, adjoining flange portion 410, is thicker than the wall of long-arm flange 302 at the downstream end of tapered portion 420, adjoining middle portion 430, with a gradual transition from the thicker wall at the upstream end to the thinner wall at the downstream end.

In an embodiment, middle portion 430 extends downstream from tapered portion 420 with a constant, substantially constant, or near-constant wall thickness. The wall thickness of middle portion 430 may have no tapering or may have a slight taper from the upstream end, adjoining tapered portion 420, to the downstream end, adjoining tip portion 440. In the event that middle portion 430 has a slight taper, it should be understood that the wall thickness at the upstream end of middle portion 430 may be slightly thicker than the wall thickness at the downstream end of middle portion 430, with a lower rate of change per unit distance in the wall thickness from end to end than in tapered portion 420.

In an embodiment, tip portion 440 extends downstream from middle portion 430 with a substantially thinner wall thickness than the downstream end of middle portion 430. In particular, tip portion 440 may be thinned to accommodate welding and support the thin walls of shroud cone 300. Tip portion 440 may have a constant or near-constant thickness. The transition between the wall thickness at the downstream end of middle portion to the wall thickness at the upstream end of tip portion 440 may be more abrupt than the tapering in tapered portion 420 and/or middle portion 430, for example, with a steep taper or no taper. In an embodiment, this transition is implemented as a surface change on only a single surface of long-arm flange 302. For example, in the illustrated embodiment, this transition occurs along the radially inner surface of long-arm flange 302 to create a radially inward-facing recess 442 along tip portion 440 and along the annular flow path of exhaust E. In an alternative embodiment, this transition could, instead, occur along the radially outer surface of long-arm flange 302 to create a radially outward-facing recess along tip portion 440, opposite the annular flow path of exhaust E. Notably, the transition between middle portion 430 and tip portion 440, on the opposite surface of long-arm flange 302 than recess 442, may be linear. For example, in the illustrated embodiment, the radially outer surface of long-arm flange 302 transitions linearly from middle portion 430 to tip portion 440.

The upstream end or leading edge of shroud cone 300 may abut and be welded into or otherwise affixed to recess 442 formed by tip portion 440. The radial depth of recess 442 may be identical or similar to the thickness of the wall of shroud cone 300 at the upstream end of shroud cone 300. Thus, when the upstream end of shroud cone 300 is welded or otherwise affixed into recess 442, the radially inner surface of middle portion 430 is substantially linearly aligned with the radially inner surface of shroud cone 300 to facilitate the aerodynamics along the annular flow path for exhaust E.

In an embodiment, a narrow gap may be provided (e.g., as part of recess 442) between the downstream end of middle portion 430 and the leading edge of shroud cone 300. This gap enables a fillet weld to be made between the radially inward-facing surface of recess 442 and the leading edge of shroud cone 300. Additionally or alternatively, a fillet weld may be made between the trailing edge of tip portion 440 and the radially outward-facing surface of shroud cone 300. Additionally or alternatively, a spot weld may be made at each of one or a plurality of contact points along the radially inward-facing surface of recess 442 and the radially outward-facing surface of shroud cone 300. Each spot weld may be made by providing a radial hole through one or both of tip portion 440 and shroud cone 300 and performing a weld through the radial hole. It should be understood that this manner of spot welding may be performed at one or a plurality of points along the contact region between tip portion 440 and shroud cone 300, and/or may be performed at a plurality of points around the circumference of this contact region between tip portion 440 and shroud cone 300. Alternatively or additionally, other methods of welding may be used, such as a continuous roll seam weld around the circumference of the contact region between tip portion 440 and shroud cone 300.

Notably, the inner diameter of long-arm flange 302 may follow or align with the profile of the inner diameter of the upstream end of shroud cone 300, to provide a smooth and aerodynamic transition between the radially inner surfaces of long-arm flange 302 and shroud cone 300. Thus, in the illustrated embodiment, since the inner diameter of the downstream end of shroud cone 300 increases at a substantially linear rate in the downstream direction, the inner diameter of long-arm flange 302 may also increase at the same substantially linear rate in the downstream direction. In alternative embodiments in which the inner diameter of the downstream end of shroud cone 300 increases at a non-linear rate, is constant, or decreases at a linear or non-linear rate in the downstream direction, the inner diameter of long-arm flange 302 may also increase at the substantially same non-linear rate, be constant, or decrease at the substantially same linear or non-linear rate, respectively, in the downstream direction.

Figure 5:
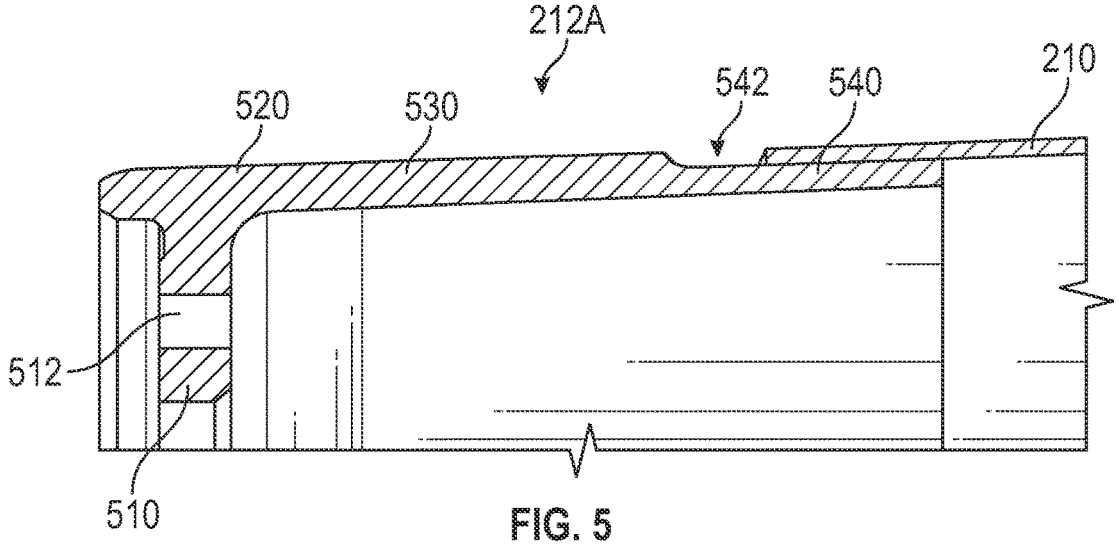

FIG. 5 illustrates a cross-sectional view of long-arm flange 212 in a cross-sectional plane that contains longitudinal axis L, according to a first embodiment 212A. Long-arm flange 212A comprises, from an upstream end to a downstream end, a flange portion 510, a tapered portion 520, a middle portion 530, and a tip portion 540.

In an embodiment, flange portion 510 extends along a radial axis (e.g., radially inward from a base of long-arm flange 212A), with apertures 512 that extend axially through flange portion 510. It should be understood that a plurality of apertures 512 may be provided at equidistant intervals around the entire annulus formed by flange portion 510. Each aperture 512 may be configured to receive a bolt or pin, may be threaded to receive a screw, or may be configured to receive any other type of fastener. Long-arm flange 212A is configured to be secured to a corresponding flange (e.g., on the downstream end of turbine 140) by bringing flange portion 510 into abutment with the corresponding flange, and inserting and securing a fastener through each aperture 512 and a corresponding aperture on the corresponding flange. However, it should be understood that any means for fastening two flanges together may be used, instead of or in addition to the disclosed means.

In an embodiment, tapered portion 520 extends downstream from flange portion 510 with a wall thickness that gradually decreases in the downstream direction. In other words, the wall of long-arm flange 212A at an upstream end of tapered portion 520, adjoining flange portion 510, is thicker than the wall of long-arm flange 212A at the downstream end of tapered portion 520, adjoining middle portion 530, with a gradual transition from the thicker wall at the upstream end to the thinner wall at the downstream end.

In an embodiment, middle portion 530 extends downstream from tapered portion 520 with a constant, substantially constant, or near-constant wall thickness. The wall thickness of middle portion 530 may have no tapering or may have a slight taper from the upstream end, adjoining tapered portion 520, to the downstream end, adjoining tip portion 540. In the event that middle portion 530 has a slight taper, it should be understood that the wall thickness at the upstream end of middle portion 530 may be slightly thicker than the wall thickness at the downstream end of middle portion 530, with a lower rate of change per unit distance in the wall thickness from end to end than in tapered portion 520.

In an embodiment, tip portion 540 extends downstream from middle portion 530 with a substantially thinner wall thickness than the downstream end of middle portion 530. In particular, tip portion 540 may be thinned to accommodate welding and support the thin walls of forward hub section 210. Tip portion 540 may have a constant or near-constant thickness. The transition between the wall thickness at the downstream end of middle portion 530 to the wall thickness at the upstream end of tip portion 540 may be more abrupt than the tapering in tapered portion 520 and/or middle portion 530, for example, with a steep taper or no taper. In an embodiment, this transition is implemented as a surface change on only a single surface of long-arm flange 212A. For example, in the illustrated embodiment, this transition occurs along the radially outer surface of long-arm flange 212A to create a radially outward-facing recess 542 along tip portion 540 and along the annular flow path of exhaust E. In an alternative embodiment, this transition could, instead, occur along the radially inner surface of long-arm flange 212A to create a radially inward-facing recess along tip portion 540, opposite the annular flow path of exhaust E. Notably, the transition between middle portion 530 and tip portion 540, on the opposite surface of long-arm flange 212A than recess 542, may be linear. For example, in the illustrated embodiment, the radially inner surface of long-arm flange 212A transitions linearly from middle portion 530 to tip portion 540.

The upstream end or leading edge of forward hub section 210 may abut and be welded into or otherwise affixed to recess 542 formed by tip portion 540. The radial depth of recess 542 may be identical or similar to the thickness of the wall of forward hub section 210 at the upstream end of forward hub section 210. Thus, when the upstream end of forward hub section 210 is welded or otherwise affixed into recess 542, the radially outer surface of middle portion 530 is substantially linearly aligned with the radially outer surface of forward hub section 210 to facilitate the aerodynamics along the annular flow path for exhaust E.

In an embodiment, a narrow gap may be provided (e.g., as part of recess 542) between the downstream end of middle portion 530 and the leading edge of forward hub section 210. This gap enables a fillet weld to be made between the radially outward-facing surface of recess 542 and the leading edge of forward hub section 210. Additionally or alternatively, a fillet weld may be made between the trailing edge of tip portion 540 and the radially inward-facing surface of forward hub section 210. Additionally or alternatively, a spot weld may be made at each of one or a plurality of contact points along the radially outward-facing surface of recess 442 and the radially inward-facing surface of forward hub section 210. Each spot weld may be made by providing a radial hole through one or both of tip portion 540 and forward hub section 210 and performing a weld through the radial hole. It should be understood that this manner of spot welding may be performed at one or a plurality of points along the contact region between tip portion 540 and forward hub section 210, and/or may be performed at a plurality of points around the circumference of this contact region between tip portion 540 and forward hub section 210. Alternatively or additionally, other methods of welding may be used, such as a continuous roll seam weld around the circumference of the contact region between tip portion 540 and forward hub section 210.

Notably, the inner diameter of long-arm flange 212A may follow or align with the profile of the inner diameter of the upstream end of forward hub section 210, to provide a smooth and aerodynamic transition between the radially outer surfaces of long-arm flange 212A and forward hub section 210. Thus, in the illustrated embodiment, since the outer diameter of the downstream end of forward hub section 210 increases at a substantially linear rate in the downstream direction, the outer diameter of long-arm flange 212A may also increase at the same substantially linear rate in the downstream direction. In alternative embodiments in which the outer diameter of the downstream end of forward hub section 210 increases at a non-linear rate, is constant, or decreases at a linear or non-linear rate in the downstream direction, the outer diameter of long-arm flange 212A may also increase at the substantially same non-linear rate, be constant, or decrease at the substantially same linear or non-linear rate, respectively, in the downstream direction.

Figure 6:
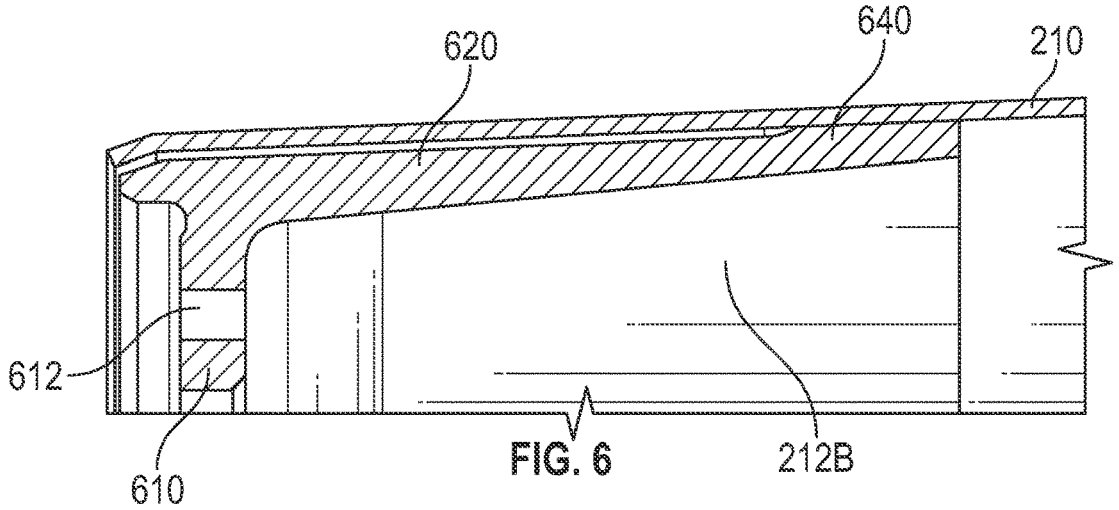

FIG. 6 illustrates a cross-sectional view of long-arm flange 212 in a cross-sectional plane that contains longitudinal axis L, according to a second embodiment 212B. Long-arm flange 212B comprises, from an upstream end to a downstream end, a flange portion 610, a tapered portion 620, and a tip portion 640. Relative to long-arm flange 212A, long-arm flange 212B may provide more support to hub 200 by increasing the area of the contact region with forward hub section 210 and/or the thickness of the portion that supports forward hub section 210.

In an embodiment, flange portion 610 in long-arm flange 212B is similar or identical to flange portion 510 in long-arm flange 212A. Therefore, any description of flange portion 510, including aperture 512, applies equally to flange portion 610, including aperture 612, and vice versa. However, in contrast to flange portion 510, the radially outer surface of flange portion 610 supports an upstream end of forward hub section 210.

In an embodiment, tapered portion 620 in long-arm flange 212B is similar or identical to tapered portion 520 in long-arm flange 212A. Therefore, any description of tapered portion 520 applies equally to tapered portion 620. However, as illustrated tapered portion 620 may be longer in an axial direction than tapered portion 520, and may decrease in thickness from the upstream end to the downstream end at a faster rate per unit distance than tapered portion 520. In addition, in contrast to tapered portion 520 and similarly to flange portion 610, the radially outer surface of tapered portion 620 supports an upstream end of forward hub section 210.

Notably, long-arm flange 212B does not comprise a middle portion, such as middle portion 530 in long-arm flange 212A. However, in an alternative embodiment, long-arm flange 212B could comprise a middle portion with a constant, substantially constant, or near-constant wall thickness.

Notably, long-arm flange 212B does not comprise a tip portion with a recess, such as tip portion 540 with recess 542 in long-arm flange 212A. Rather, long-arm flange 212B comprises a tip portion 640 that acts as a platform or contact landing for forward hub section 210. Tip portion 640 may be tapered, such that the wall thickness gradually decreases in the downstream direction. In addition, the upstream end of tip portion 640 may be slightly thicker than the downstream end of tapered portion 620. The transition between the wall thickness at the downstream end of tapered portion 620 to the wall thickness at the upstream end of tip portion 640 may be more abrupt than the tapering in tapered portion 620, for example, with a steep taper or not taper. In an embodiment, this transition is implemented as a surface change on only a single surface of long-arm flange 212B. For example, in the illustrated embodiment, this transition occurs along the radially outer surface of long-arm flange 212B. Notably, the transition between tapered portion 620 and tip portion 640, on the opposing radially inner surface of long-arm flange 212B may be linear. For example, in the illustrated embodiment, the radially inner surface of long-arm flange 212B transitions linearly from tapered portion 620 to tip portion 640.

The upstream end or leading edge of forward hub section 210 may abut and be welded or otherwise affixed to the contact landing formed by tip portion 640. A fillet weld may be made between the trailing edge of tip portion 640 and the radially inward-facing surface of forward hub section 210. Additionally or alternatively, a spot weld may be made at each of one or a plurality of contact points along the radially outward-facing surface of tip portion 640 and the radially inward-facing surface of forward hub section 210. Each spot weld may be made by providing a radial hole through one or both of tip portion 640 and forward hub section 210 and performing a weld through the radial hole. It should be understood that this manner of spot welding may be performed at one or a plurality of points along the contact region between tip portion 640 and forward hub section 210, and/or may be performed at a plurality of points around the circumference of this contact region between tip portion 640 and forward hub section 210. Alternatively or additionally, other methods of welding may be used, such as a continuous roll seam weld around the circumference of the contact region between tip portion 640 and forward hub section 210.

Notably, since forward hub section 210 surrounds long-arm flange 212B along its entire axial length, long-arm flange 212B is not exposed to the annular flow path of exhaust E. In addition, there is no gap or other discontinuity along the radially outer surface of hub 200. This may be provide improved aerodynamics along the annular flow path, relative to long-arm flange 212A. In addition, long-arm flange 212B may provide improved support of hub 200, relative to long-arm flange 212A, since the entire axial length of long-arm flange 212B supports forward hub section 210, as opposed to just tip portion 540 supporting forward hub section 210.

Figure 7:
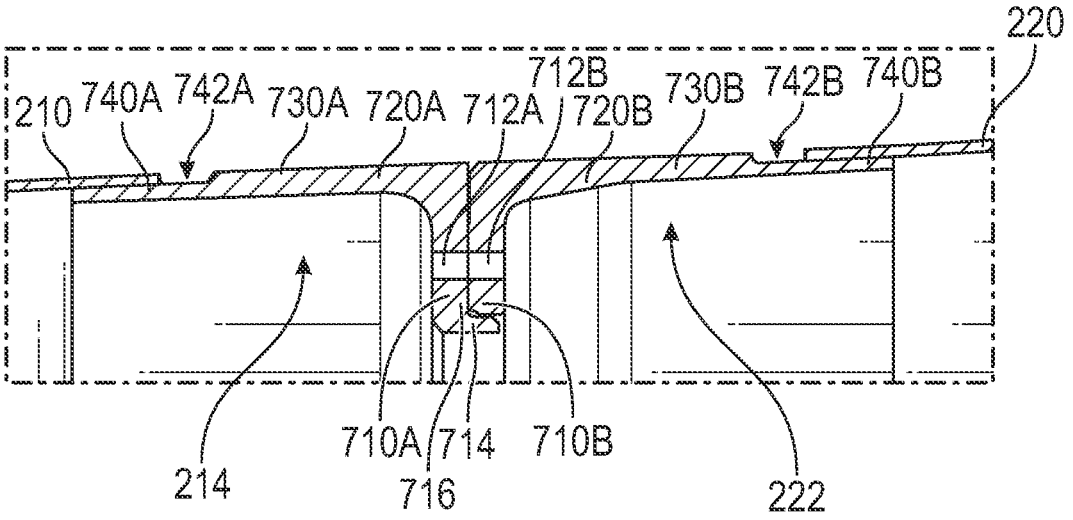

FIG. 7 illustrates a cross-sectional view of long-arm flanges 214 and 222 in a cross-sectional plane that contains longitudinal axis L, according to an embodiment. Long-arm flange 214 comprises, from an upstream end to a downstream end, a tip portion 740A, a middle portion 730A, a tapered portion 720A, and a flange portion 710A. Long-arm flange 222 comprises, from an upstream end to a downstream end, a flange portion 710B, a tapered portion 720B, a middle portion 730B, and a tip portion 740B.

In an embodiment, each flange portion 710A and 710B extends along a respective radial axis (e.g., radially inward from a base of the respective long-arm flange). Apertures 712A and 712B extend axially through flange portions 710A and 710B, respectively. It should be understood that a plurality of apertures 712A and 712B may be provided at equidistant intervals around the entire annulus formed by flange portions 710A and 710B, respectively. Each aperture 712A and 712B may be configured to receive a bolt or pin, may be threaded to receive a screw, or may be configured to receive any other type of fastener. Long-arm flange 214 is configured to be secured to long-arm flange 222 by bringing flange portions 710A and 710B into abutment, aligning apertures 712A with apertures 712B, and inserting and securing a fastener through the aligned apertures 712A/712B. However, it should be understood that any means for fastening two flanges together may be used, instead of or in addition to the disclosed means.

Flange portion 710A of long-arm flange 214 may extend farther radially inward than flange portion 710B of long-arm flange 222, and comprise a lip 714 at the radially innermost end of flange portion 710A. Lip 714 may extend in a substantially axial downstream direction from flange portion 710A, such that a radially outward-facing surface of lip 714 abuts a radially inward-facing surface of the radially innermost end of flange portion 710B. Thus, lip 714 of long-arm flange 214 supports long-arm flange 222 and may be welded to long-arm flange 222. In an alternative embodiment, flange portion 710B of long-arm flange 222 may extend farther radially inward than flange portion 710A of long-arm flange 214, and comprise a lip at the radially innermost end that extends in a substantially axial upstream direction to abut, support, and be welded to a radially innermost end of flange portion 710A.

Flange portion 710B of long-arm flange 214 may comprise a contact landing 716 on the upstream-facing surface that abuts the downstream-facing surface of flange portion 710A of long-arm flange 214. Alternatively, flange portion 710A of long-arm flange 214 could comprise a contact landing on the downstream-facing surface that abuts the upstream-facing surface of flange portion 710B of long-arm flange 222. In either case, the contact landing provides a seal between the two flange portions 710A and 710B to prevent the intrusion of exhaust E. Aperture 712B may be provided through contact landing 716, such that the force of the fastener, inserted through aperture 712B, is applied directly to contact landing 716.

In an embodiment, tapered portions 720A and 720B extend from flange portion 710A and 710B, respectively, with a wall thickness that gradually decreases as the distance from flange portion 710A and 710B, respectively, increases. In other words, the wall of long-arm flange 214 at the upstream end of tapered portion 720A is thinner than the wall of long-arm flange 214 at the downstream end of tapered portion 720A, with a gradual transition from the thinner wall at the upstream end to the thicker wall at the downstream end. Conversely, the wall of long-arm flange 222 at an upstream end of tapered portion 720B is thicker than the wall of long-arm flange 222 at the downstream end of tapered portion 720B, with a gradual transition from the thicker wall at the upstream end to the thinner wall at the downstream end.

In an embodiment, middle portions 730A and 730B extend from tapered portions 720A and 720B, respectively, with a constant, substantially constant, or near-constant wall thickness. The wall thickness of middle portions 730A and/or 730B may have no tapering or may have a slight taper. In the event that middle portion 730A or 730B has a slight taper, it should be understood that the wall thickness may be slightly thicker at the end that is closest to tapered portion 720A or 720B, respectively, than the wall thickness at the other end, with a lower rate of change per unit distance in the wall thickness from end to end than in tapered portion 720A or 720B, respectively.

In an embodiment, tip portions 740A and 740B extend from middle portions 730A and 730B, respectively, with a substantially thinner wall thickness than the adjoining ends of middle portions 730A and 730B, respectively. In particular, tip portions 740A and 740B may be thinned to accommodate welding and support the thin walls of their respective hub sections. Each of tip portions 740A and 740B may have a constant or near-constant thickness. The transitions between the wall thickness from the adjoining ends of middle portions 730A and 730B to the wall thickness at the adjoining ends of tip portions 740A and 740B, respectively, may be more abrupt than the tapering in tapered portions 720A/730A and 720B/730B, respectively, for example, with a steep taper or no taper. In an embodiment, each transition is implemented as a surface change on only a single surface of long-arm flanges 214 and 222, and on the same side for both long-arm flanges 214 and 222. For example, in the illustrated embodiment, this transition occurs along the radially outer surface of long-arm flanges 214 and 222 to create radially outward-facing recesses 742A and 742B, respectively, along tip portions 740A and 740B, respectively, and along the annular flow path of exhaust E. In an alternative embodiment, this transition could, instead, occur along the radially inner surface of long-arm flanges 214 and 222 to create radially inward-facing recesses along tip portion 740A and 740B, respectively, opposite the annular flow path of exhaust E. Notably, the transition from middle portions 730A and 730B to tip portions 740A and 740B, respectively, on the opposite surface of long-arm flanges 214 and 222 than recesses 742A and 742B, respectively, may be linear. For example, in the illustrated embodiment, the radially inner surfaces of long-arm flanges 214 and 222 transition linearly from middle portions 730A and 730B, respectively, to tip portions 740A and 740B, respectively.

The downstream end or trailing edge of forward hub section 210 may abut and be welded into or otherwise affixed to recess 742A formed by tip portion 740A. The radial depth of recess 742A may be identical or similar to the thickness of the wall of forward hub section 210 at the downstream end of forward hub section 210. Thus, when the downstream end of forward hub section 210 is welded or otherwise affixed into recess 742A, the radially outer surface of middle portion 730A is substantially linearly aligned with the radially outer surface of forward hub section 210 to facilitate the aerodynamics along the annular flow path for exhaust E.

Similarly, the upstream end or leading edge of middle hub section 220 may abut and be welded into or otherwise affixed to recess 742B formed by tip portion 740B. The radial depth of recess 742B may be identical or similar to the thickness of the wall of middle hub section 220 at the upstream end of middle hub section 220. Thus, when the upstream end of middle hub section 220 is welded or otherwise affixed into recess 742B, the radially outer surface of middle portion 730B is substantially linearly aligned with the radially outer surface of middle hub section 220 to facilitate the aerodynamics along the annular flow path for exhaust E.

In an embodiment, a narrow gap may be provided (e.g., as part of recesses 742A and 742B) between an end of middle portions 730A and 730B and the end of forward hub section 210 and middle hub section 220, respectively. This gap enables fillet welds to be made between the radially outward-facing surface of recess 742A and the trailing edge of forward hub section 210 and between the radially outward-facing surface of recess 742B and the leading edge of middle hub section 220. Additionally or alternatively, a fillet weld may be made between the leading edge of tip portion 740A and the radially inward-facing surface of forward hub section 210 and between the trailing edge of tip portion 740B and the radially inward-facing surface of middle hub section 220. Additionally or alternatively, a spot weld may be made at each of one or a plurality of contact points along the radially outward-facing surface of recess 742A and the radially inward-facing surface of forward hub section 210 and along the radially outward-facing surface of recess 742B and the radially inward-facing surface of middle hub section 220. Each spot weld may be made by providing a radial hole through one or both of the respective tip portion 740A or 740B and forward hub section 210 or middle hub section 220, respectively, and performing a weld through the radial hole. It should be understood that this manner of spot welding may be performed at one or a plurality of points along the contact region between tip portion 740A and forward hub section 210 and/or between tip portion 740B and middle hub section 220, and/or may be performed at a plurality of points around the circumference of one or both of these contact regions. Alternatively or additionally, other methods of welding may be used, such as a continuous roll seam weld around the circumference of the contact region between tip portion 740A and forward hub section 210 and/or between tip portion 740B and middle hub section 220.

Notably, the outer diameters of long-arm flanges 214 and 222 may follow the profile of the outer diameters of the downstream end of forward hub section 210 and the upstream end of middle hub section 220, to provide a smooth and aerodynamic transition along the entire connection region between forward hub section 210 and middle hub section 220. Thus, in the illustrated embodiment, since the outer diameter of the connection area between forward hub section 210 and middle hub section 220 increases at a substantially linear rate in the downstream direction, the outer diameters of long-arm flanges 214 and 222 may also increase at the same substantially linear rate in the downstream direction. In general, regardless of whether this connection area increases at a linear or non-linear rate, is constant, or decreases at a linear or non-linear rate in the downstream direction, the outer diameters of long-arm flanges 214 and 222 may follow the same profile to provide a smooth and aerodynamic transition along the entire connection area.

Figure 8:
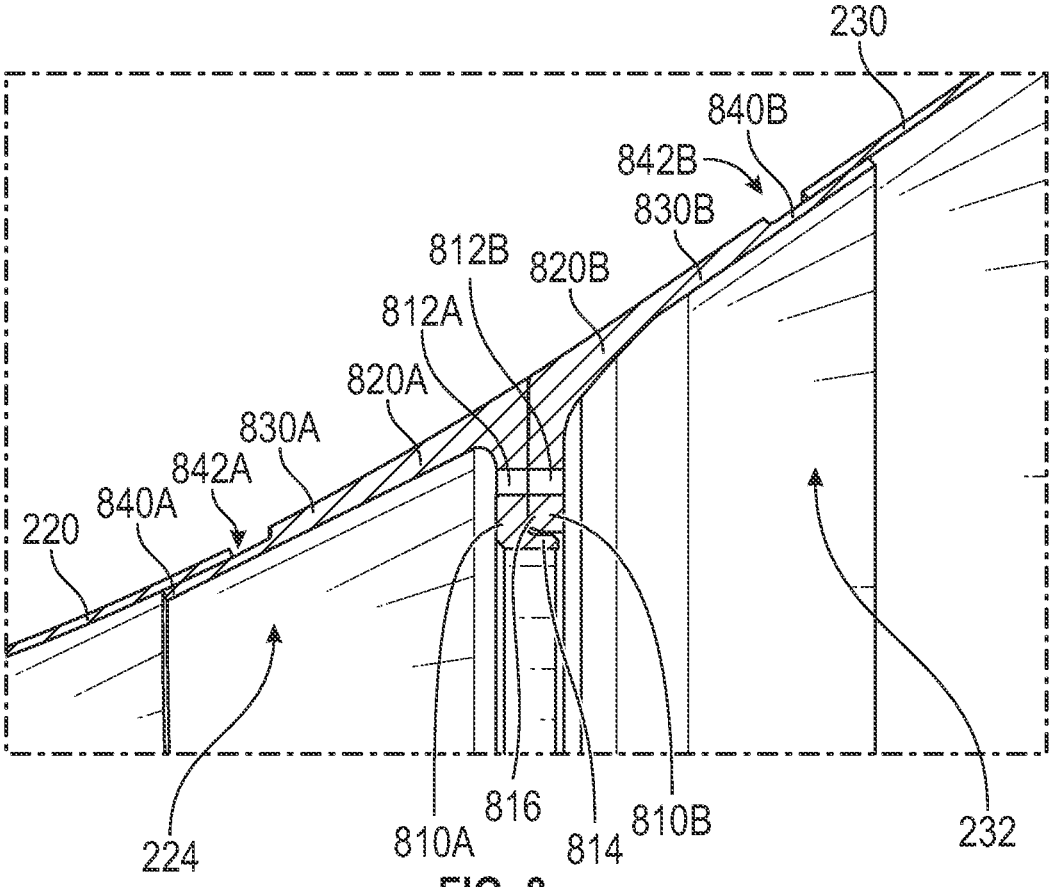

FIG. 8 illustrates a cross-sectional view of long-arm flanges 224 and 232 in a cross-sectional plane that contains longitudinal axis L, according to an embodiment. Long-arm flange 224 comprises, from an upstream end to a downstream end, a tip portion 840A, a middle portion 830A, a tapered portion 820A, and a flange portion 810A. Long-arm flange 232 comprises, from an upstream end to a downstream end, a flange portion 810B, a tapered portion 820B, a middle portion 830B, and a tip portion 840B.

In an embodiment, each flange portion 810A and 810B extends along a respective radial axis (e.g., radially inward from a base of the respective long-arm flange). Apertures 812A and 812B extend axially through flange portions 810A and 810B, respectively. It should be understood that a plurality of apertures 812A and 812B may be provided at equidistant intervals around the entire annulus formed by flange portions 810A and 810B, respectively. Each aperture 812A and 812B may be configured to receive a bolt or pin, may be threaded to receive a screw, or may be configured to receive any other type of fastener. Long-arm flange 224 is configured to be secured to long-arm flange 232 by bringing flange portions 810A and 810B into abutment, aligning apertures 812A with apertures 812B, and inserting and securing a fastener through the aligned apertures 812A/812B. However, it should be understood that any means for fastening two flanges together may be used, instead of or in addition to the disclosed means.

Flange portion 810A of long-arm flange 224 may extend farther radially inward than flange portion 810B of long-arm flange 232, and comprise a lip 814 at the radially innermost end of flange portion 810A. Lip 814 may extend in a substantially axial downstream direction from flange portion 810A, such that a radially outward-facing surface of lip 814 abuts a radially inward-facing surface of the radially innermost end of flange portion 810B. Thus, lip 814 of long-arm flange 224 supports long-arm flange 232 and may be welded to long-arm flange 232. In an alternative embodiment, flange portion 810B of long-arm flange 232 may extend farther radially inward than flange portion 810A of long-arm flange 224, and comprise a lip at the radially innermost end that extends in a substantially axial upstream direction to abut, support, and be welded to a radially innermost end of flange portion 810A.

Flange portion 810B of long-arm flange 232 may comprise a contact landing 816 on the upstream-facing surface that abuts the downstream-facing surface of flange portion 810A of long-arm flange 224. Alternatively, flange portion 810A of long-arm flange 224 could comprise a contact landing on the downstream-facing surface that abuts the upstream-facing surface of flange portion 810B of long-arm flange 232. In either case, the contact landing provides a seal between the two flange portions 810A and 810B to prevent the intrusion of exhaust E. Aperture 812B may be provided through contact landing 816, such that the force of the fastener, inserted through aperture 812B, is applied directly to contact landing 816.

In an embodiment, tapered portions 820A and 820B extend from flange portion 810A and 810B, respectively, with a wall thickness that gradually decreases as the distance from flange portion 810A and 810B, respectively, increases. In other words, the wall of long-arm flange 224 at the upstream end of tapered portion 820A is thinner than the wall of long-arm flange 224 at the downstream end of tapered portion 820A, with a gradual transition from the thinner wall at the upstream end to the thicker wall at the downstream end. Conversely, the wall of long-arm flange 232 at an upstream end of tapered portion 820B is thicker than the wall of long-arm flange 232 at the downstream end of tapered portion 820B, with a gradual transition from the thicker wall at the upstream end to the thinner wall at the downstream end.

In an embodiment, middle portions 830A and 830B extend from tapered portions 820A and 820B, respectively, with a constant, substantially constant, or near-constant wall thickness. The wall thickness of middle portions 830A and/or 830B may have no tapering or may have a slight taper. In the event that middle portion 830A or 830B has a slight taper, it should be understood that the wall thickness may be slightly thicker at the end that is closest to tapered portion 820A or 820B, respectively, than the wall thickness at the other end, with a lower rate of change per unit distance in the wall thickness from end to end than in tapered portion 820A or 820B, respectively.

In an embodiment, tip portions 840A and 840B extend from middle portions 830A and 830B, respectively, with a substantially thinner wall thickness than the adjoining ends of middle portions 830A and 830B, respectively. In particular, tip portions 840A and 840B may be thinned to accommodate welding and support the thin walls of their respective hub sections. Each of tip portions 840A and 840B may have a constant or near-constant thickness. The transitions between the wall thickness from the adjoining ends of middle portions 830A and 830B to the wall thickness at the adjoining ends of tip portions 840A and 840B, respectively, may be more abrupt than the tapering in tapered portions 820A/830A and 820B/830B, respectively, for example, with a steep taper or no taper. In an embodiment, each transition is implemented as a surface change on only a single surface of long-arm flanges 224 and 232, and on the same side for both long-arm flanges 224 and 232. For example, in the illustrated embodiment, this transition occurs along the radially outer surface of long-arm flanges 224 and 232 to create radially outward-facing recesses 842A and 842B, respectively, along tip portions 840A and 840B, respectively, and along the annular flow path of exhaust E. In an alternative embodiment, this transition could, instead, occur along the radially inner surface of long-arm flanges 224 and 232 to create radially inward-facing recesses along tip portion 840A and 840B, respectively, opposite the annular flow path of exhaust E. Notably, the transition from middle portions 830A and 830B to tip portions 840A and 840B, respectively, on the opposite surface of long-arm flanges 224 and 232 than recesses 842A and 842B, respectively, may be linear. For example, in the illustrated embodiment, the radially inner surfaces of long-arm flanges 224 and 232 transition linearly from middle portions 830A and 830B, respectively, to tip portions 840A and 840B, respectively.

The downstream end or trailing edge of middle hub section 220 may abut and be welded into or otherwise affixed to recess 842A formed by tip portion 840A. The radial depth of recess 842A may be identical or similar to the thickness of the wall of middle hub section 220 at the downstream end of middle hub section 220. Thus, when the downstream end of middle hub section 220 is welded or otherwise affixed into recess 842A, the radially outer surface of middle portion 830A is substantially linearly aligned with the radially outer surface of middle hub section 210 to facilitate the aerodynamics along the annular flow path for exhaust E.

Similarly, the upstream end or leading edge of aft hub section 230 may abut and be welded into or otherwise affixed to recess 842B formed by tip portion 840B. The radial depth of recess 842B may be identical or similar to the thickness of the wall of aft hub section 230 at the upstream end of aft hub section 230. Thus, when the upstream end of aft hub section 230 is welded or otherwise affixed into recess 842B, the radially outer surface of middle portion 830B is substantially linearly aligned with the radially outer surface of aft hub section 230 to facilitate the aerodynamics along the annular flow path for exhaust E.

In an embodiment, a narrow gap may be provided (e.g., as part of recesses 842A and 842B) between an end of middle portions 830A and 830B and the end of middle hub section 220 and aft hub section 230, respectively. This gap enables fillet welds to be made between the radially outward-facing surface of recess 842A and the trailing edge of middle hub section 220 and between the radially outward-facing surface of recess 842B and the leading edge of aft hub section 230. Additionally or alternatively, a fillet weld may be made between the leading edge of tip portion 840A and the radially inward-facing surface of middle hub section 220 and between the trailing edge of tip portion 840B and the radially inward-facing surface of aft hub section 230. Additionally or alternatively, a spot weld may be made at each of one or a plurality of contact points along the radially outward-facing surface of recess 842A and the radially inward-facing surface of middle hub section 220 and along the radially outward-facing surface of recess 842B and the radially inward-facing surface of aft hub section 230. Each spot weld may be made by providing a radial hole through one or both of the respective tip portion 840A or 840B and middle hub section 220 or aft hub section 230, respectively, and performing a weld through the radial hole. It should be understood that this manner of spot welding may be performed at one or a plurality of points along the contact region between tip portion 840A and middle hub section 220 and/or between tip portion 840B aft hub section 230, and/or may be performed at a plurality of points around the circumference of one or both of these contact regions. Alternatively or additionally, other methods of welding may be used, such as a continuous roll seam weld around the circumference of the contact region between tip portion 840A and middle hub section 220 and/or between tip portion 840B and aft hub section 230.

Notably, the outer diameters of long-arm flanges 224 and 232 may follow the profile of the outer diameters of the downstream end of middle hub section 220 and the upstream end of aft hub section 230, to provide a smooth and aerodynamic transition along the entire connection region between middle hub section 220 and aft hub section 230. Thus, in the illustrated embodiment, since the outer diameter of the connection area between middle hub section 220 and aft hub section 230 increases at a slightly non-linear rate in the downstream direction, the outer diameters of long-arm flanges 224 and 232 may also increase at the same substantially non-linear rate in the downstream direction. In general, regardless of whether this connection area increases at a linear or non-linear rate, is constant, or decreases at a linear or non-linear rate in the downstream direction, the outer diameters of long-arm flanges 224 and 232 may follow the same profile to provide a smooth and aerodynamic transition along the entire connection area.

INDUSTRIAL APPLICABILITY

An exhaust outlet 150 may comprise a hub 200 and/or shroud cone 300 made from thin-walled materials (e.g., 0.09 inches to 0.16 inches thick), such as sheet metal. As the length of exhaust outlet 150 increases, the bending stress and other mechanical loads on the thin-walled materials and their joints will increase. In addition, the joints generally comprise joined flanges that are made from a different material than the material from which hub 200 and shroud cone 300 are made, and therefore, may have different thermal expansion coefficients. For example, hub 200 and shroud cone 300 may be made primarily from 409 stainless steel, whereas the flanges may be made from 430 stainless steel. The difference in thermal expansion coefficients imposes thermal stress on the joints. These mechanical stresses and thermal stresses can reduce the lifetime and compromise the durability of the joints in exhaust outlet 150.

The disclosed embodiments of long-arm flanges, such as long-arm flanges 212, 214, 222, 224, 232, and 302, may be used to address at least these problems discovered in exhaust outlets 150. For example, the lengths of long-arm flanges 212, 214, 222, 224, 232, and 302 provide better support to the thin-walled components of hub 200 and shroud cone 300 by more evenly distributing the stress over a longer distance and larger area. It should be understood that the exact lengths of long-arm flanges 212, 214, 222, 224, 232, and 302 will depend on the scale of exhaust outlet 150. In a typical implementation, the ratio of the length of a long-arm flange to the length of the component to which it is welded, along an axial axis, may be in the range of about 0.1 to 0.4. However, it should be understood that other ratio values are possible, depending on the particular design.

In addition, the distance between flange portions 410, 510, 610, 710A/710B, and 810A/810B and the weld points at their respective tip portions 440, 540, 640, 740A/740B, and 840A/840B, decouples the mechanical stress from the thermal stress experienced by the long-arm flanges 212, 214, 222, 224, 232, and 302. This decoupling reduces the stress at flange portions 410, 510, 610, 710A/710B, and 810A/810B, caused by differences in the thermal expansion coefficients of the different materials. In addition, the increase in surface area that is exposed to the annular flow path, resulting from the lengths of long-arm flanges 212, 214, 222, 224, 232, and 302, can provide a faster response to transient temperature changes in the annular flow path, and thereby reduce thermal gradients in the radial direction.

The tapering of the wall thickness in tapered portions 420, 520, 620, 720A/720B, and 810A/810B, as well as optionally in middle portions 430, 530, 730A/730B, and 830A/830B, controls stress distribution. In particular, the bending-moment load is primarily borne by the thicker end of the respective long-arm flange (e.g., closer to flange portions 410, 510, 610, 710A/710B, and 810A/810B). This tapering also provides a gradual transition from a thicker-walled portion to thin tip portions 440, 540, 640, 740A/740B, and 840A/840B to facilitate welds at these tip portions.

Furthermore, as demonstrated by FIGS. 4-8, the disclosed structure of long-arm flanges 212, 214, 222, 224, 232, and 302 can be flexibly shaped to fit the geometry of any aerodynamic flow path. For example, the surfaces of long-arm flanges 212, 214, 222, 224, 232, and 302 that are within the annular flow path of exhaust E may be aligned with the surfaces of the respective thin-walled component to which they are welded, as well as with the surface of any adjacent long-arm flange, to form a smooth and aerodynamic joint. For example, the inner diameter of long-arm flange 302, including recess 442, is configured such that the radially inner surface of long-arm flange 302 aligns with the radially inner surface of shroud cone 300 (e.g., the two surfaces would be flush except for the groove formed by the gap between middle portion 430 and the leading edge of shroud cone 300). Similarly, the outer diameter of long-arm flange 212A, including recess 542, is configured such that the radially outer surface of long-arm flange 212A aligns with the radially outer surface of forward hub section 210 (e.g., the two surfaces would be flush except for the groove formed by the gap between middle portion 530 and the leading edge of forward hub section 210). Similarly, the outer diameters of long-arm flange 214 and 222, including recesses 742A and 742B, are configured such that the radially outer surfaces of long-arm 214 and 222 align with the radially outer surfaces of forward hub section 210 and middle hub section 220 and with each other (e.g., the surfaces across the entire joint would be flush except for the grooves formed by the gaps between middle portion 730A and the trailing edge of forward hub section 210 and between middle portion 730B and the leading edge of middle hub section 220). Similarly, the outer diameters of long-arm flange 224 and 232, including recesses 842A and 842B, are configured such that the radially outer surfaces of long-arm 224 and 232 align with the radially outer surfaces of middle hub section 220 and aft hub section 230 and with each other (e.g., the surfaces across the entire joint would be flush except for the grooves formed by the gaps between middle portion 830A and the trailing edge of middle hub section 220 and between middle portion 830B and the leading edge of aft hub section 230). Thus, the disclosed structure can be easily adapted to the specific geometry of any exhaust outlet by adjusting the surfaces of each of long-arm flanges 212, 214, 222, 224, 232, and 302, to obtain one or more of the advantages described herein.

It will be understood that the benefits and advantages described above may relate to one embodiment or may relate to several embodiments. Aspects described in connection with one embodiment are intended to be able to be used with the other embodiments. Any explanation in connection with one embodiment applies to similar features of the other embodiments, and elements of multiple embodiments can be combined to form other embodiments. The embodiments are not limited to those that solve any or all of the stated problems or those that have any or all of the stated benefits and advantages.

The preceding detailed description is merely exemplary in nature and is not intended to limit the invention or the application and uses of the invention. The described embodiments are not limited to usage in conjunction with a particular type of machine. Hence, although the present embodiments are, for convenience of explanation, depicted and described as being implemented in a gas turbine engine, it will be appreciated that it can be implemented in various other types of turbomachines and machines with thin-walled parts that need to be connected and supported, and in various other systems and environments. Furthermore, there is no intention to be bound by any theory presented in any preceding section. It is also understood that the illustrations may include exaggerated dimensions and graphical representation to better illustrate the referenced items shown, and are not considered limiting unless expressly stated as such.

What is claimed is:

1. An annular flange for joining one or more annular sections of an exhaust flow path having a longitudinal axis, the annular flange comprising:

an annular flange portion extending in a radial direction relative to the longitudinal axis, a tapered portion extending from a radially outer most portion of the annular flange portion in an axial direction that is perpendicular to the radial direction, the tapered portion having a first end that is closest to the annular flange portion and a second end that is farthest from the annular flange portion, the tapered portion being thicker at the first end than at the second end, and a tip portion on an opposite side of the tapered portion as the annular flange portion, the tip portion having a different thickness than the second end of the tapered portion.

2. The exhaust outlet of claim 1, further comprising a middle portion between the tapered portion and the tip portion, wherein the middle portion has a constant thickness.

3. The exhaust outlet of claim 2, wherein the tip portion is thinner than the middle portion.

4. The exhaust outlet of claim 1, wherein the tip portion extends from the second end of the tapered portion, and an end of the tip portion adjacent to the second end of the tapered portion is thicker than the second end of the tapered portion.

5. The exhaust outlet of claim 4, wherein the tip portion is tapered, such that a thickness of the tip portion decreases as a distance from the second end of the tapered portion increases.

6. An exhaust outlet comprising:

a hub having a longitudinal axis;

a shroud cone encircling the hub to define an annular flow path between the hub and the shroud cone; and a long-arm flange comprising a flange portion extending in a radial direction that is orthogonal to the longitudinal axis, a tapered portion extending from the flange portion in an axial direction that is parallel to the longitudinal axis, the tapered portion having a first end that is closest to the flange portion and a second end that is farthest from the flange portion, the tapered portion being thicker at the first end than at the second end, and a tip portion on an opposite side of the tapered portion as the flange portion, the tip portion having a different thickness than the second end of the tapered portion;

wherein each of the hub and the shroud comprises one or more sections; and wherein the tip portion of the long-arm flange is welded to an end of one of the one or more sections.

7. The exhaust outlet of claim 6, wherein the long-arm flange is welded to the end of the one section only at the tip portion.

8. The exhaust outlet of claim 6, wherein the long-arm flange further comprises a middle portion between the tapered portion and the tip portion, wherein the middle portion has a constant thickness.

9. The exhaust outlet of claim 8, wherein the tip portion is thinner than the middle portion to form a recess configured to receive the end of the one section.

10. The exhaust outlet of claim 9, wherein a depth of the recess is equal to a thickness of the end of the one section.

11. The exhaust outlet of claim 6, wherein the tip portion extends from the second end of the tapered portion, and an end of the tip portion adjacent to the second end of the tapered portion is thicker than the second end of the tapered portion.

12. The exhaust outlet of claim 11, wherein the tip portion is tapered, such that a thickness of the tip portion decreases as a distance from the second end of the tapered portion increases.

13. The exhaust outlet of claim 6, wherein the end of the one section is an upstream end of the hub or shroud cone.

14. The exhaust outlet of claim 6, comprising a plurality of the long-arm flange, wherein one or both of the hub and the shroud cone comprise a plurality of separate sections, wherein each of the plurality of long-arm flanges is welded to either the upstream end or the downstream end of one of the plurality of separate sections.

15. The exhaust outlet of claim 14, wherein, for each pair of adjacent ones of the plurality of sections, comprising an upstream section and a downstream section:

a trailing edge of the upstream section is welded to the tip portion of a first one of the plurality of long-arm flanges, such that the flange portion of the first long-arm flange is downstream from the tip portion of the first long-arm flange;

a leading edge of the downstream section is welded to the tip portion of a second one of the plurality of long-arm flanges, such that the flange portion of the second long-arm flange is upstream from the tip portion of the second long-arm flange; and the first long-arm flange is fastened to the second long-arm flange.

16. The exhaust outlet of claim 15, wherein surfaces of the first long-arm flange and the second long-arm flange that are within the annular flow path are aligned with surfaces of the upstream section and the downstream section that are within the annular flow path.

17. The exhaust outlet of claim 15, wherein the flange portion of one of the first long-arm flange and the second long-arm flange extends farther in the radial direction than the other one of the first long-arm flange and the second long-arm flange and comprises a lip that extends axially to contact a radially inward-facing surface of the flange portion of the other one of the first long-arm flange and the second long-arm flange.

18. The exhaust outlet of claim 17, wherein the lip is welded to the flange portion of the other one of the first long-arm flange and the second long-arm flange.

19. A gas turbine engine comprising:

a compressor;

a combustor downstream from the compressor;

a turbine downstream from the combustor, the downstream end of the turbine including a flange; and the exhaust outlet of claim 6 downstream from the turbine, wherein the long-arm flange of the exhaust outlet is fastened to the flange at the downstream end of the turbine.

20. An exhaust outlet comprising:

a hub having a longitudinal axis, the hub including a forward hub section, a middle hub section, and an aft hub section;

a shroud cone encircling the hub to define an annular flow path between the hub and the shroud cone; and a plurality of long-arm flanges, each of the plurality of long-arm flanges including a flange portion extending in a radial direction that is orthogonal to the longitudinal axis, a tapered portion extending from the flange portion in an axial direction that is parallel to the longitudinal axis, the tapered portion having a first end that is closest to the flange portion and a second end that is farthest from the flange portion, the tapered portion being thicker at the first end than at the second end, and a tip portion on an opposite side of the tapered portion as the flange portion, the tip portion having a different thickness than the second end of the tapered portion;

wherein the plurality of long-arm flanges comprises a first long-arm flange whose tip portion is welded to an upstream end of the shroud cone, a second long-arm flange whose tip portion is welded to an upstream end of the forward hub section, a third long-arm flange whose tip portion is welded to a downstream end of the forward hub section, a fourth long-arm flange whose tip portion is welded to an upstream end of the middle hub section and whose flange portion is fastened to the flange portion of the third long-arm flange, a fifth long-arm flange whose tip portion is welded to a downstream end of the middle hub section, and a sixth long-arm flange whose tip portion is welded to an upstream end of the aft hub section and whose flange portion is fastened to the flange portion of the fifth long-arm flange.

* * * * *